US010172402B2

(12) United States Patent
Berry

(10) Patent No.: US 10,172,402 B2
(45) Date of Patent: Jan. 8, 2019

(54) HAND COVERING APPARATUS

(71) Applicant: Stephanie Alexander Berry, Madison, VA (US)

(72) Inventor: Stephanie Alexander Berry, Madison, VA (US)

( * ) Notice: Subject to any disclaimer, the term of this patent is extended or adjusted under 35 U.S.C. 154(b) by 14 days.

(21) Appl. No.: 15/058,022

(22) Filed: Mar. 1, 2016

(65) Prior Publication Data

US 2016/0255892 A1 Sep. 8, 2016

Related U.S. Application Data

(60) Provisional application No. 62/126,765, filed on Mar. 2, 2015.

(51) Int. Cl.

| | |
|---|---|
| ***A41F 1/06*** | (2006.01) |
| ***A41D 19/00*** | (2006.01) |
| ***A41D 19/01*** | (2006.01) |

(52) U.S. Cl.

CPC ..... *A41F 1/06* (2013.01); *A41D 19/0013* (2013.01); *A41D 19/0034* (2013.01); *A41D 19/0048* (2013.01); *A41D 19/01* (2013.01); *A41D 2300/32* (2013.01); *A41D 2400/44* (2013.01); *A41D 2400/70* (2013.01)

(58) Field of Classification Search

CPC ..... A41F 1/06; A41D 19/00; A41D 19/0034; A41D 19/0041; A41D 19/0048

See application file for complete search history.

(56) References Cited

U.S. PATENT DOCUMENTS

| | | | | |
|---|---|---|---|---|
| 1,361,565 | A * | 12/1920 | Christy | A41D 19/0041 2/158 |
| 1,507,153 | A * | 9/1924 | Binns | A41F 1/06 2/159 |
| 2,590,015 | A * | 3/1952 | Kennedy | A41F 1/06 2/162 |
| 3,476,108 | A * | 11/1969 | Matukas | A61F 5/37 128/879 |
| 4,615,049 | A * | 10/1986 | Samelian | A41F 1/06 2/163 |
| 4,924,530 | A | 5/1990 | Tagaya | |
| 5,117,508 | A * | 6/1992 | Gunter | A41D 19/0027 2/160 |
| 5,295,269 | A | 5/1994 | Ballard | |
| 5,528,773 | A | 6/1996 | Lowinger | |
| 5,742,942 | A | 4/1998 | Sykes | |
| 6,061,822 | A | 5/2000 | Smith | |
| 6,279,166 | B1 * | 8/2001 | Schild | A41D 19/02 2/160 |
| 6,454,681 | B1 | 9/2002 | Brassil | |
| 8,060,949 | B2 | 11/2011 | Carcaterra | |

(Continued)

*Primary Examiner* — Sally Haden

(74) *Attorney, Agent, or Firm* — Brooklyn Law IP Clinic; Thomas Landman; Serge Krimnus

(57) ABSTRACT

In one embodiment, a hand apparatus, such as a glove or a mitten, with attachable securing members is disclosed. The hand apparatus can have a hand receiving portion, one or more finger portions, a thumb portion, and a body portion. The body portion comprises a dorsal side, a palm side, a first securing member, and a second securing member. The body portion can also comprise of a third securing member attached between the far side and near side of the body portion. The securing members can be attachable to the other securing members by fasteners.

10 Claims, 5 Drawing Sheets

(56) References Cited

U.S. PATENT DOCUMENTS

| | | | | |
|---|---|---|---|---|
| 2006/0048269 | A1 | 3/2006 | Vannini | |
| 2008/0263747 | A1* | 10/2008 | DeBlasis | A41F 1/06 2/161.1 |
| 2009/0293172 | A1* | 12/2009 | Carota | A41D 19/01 2/158 |
| 2012/0210485 | A1* | 8/2012 | Clement | A63B 71/145 2/20 |
| 2013/0000006 | A1* | 1/2013 | Norton | A41F 1/06 2/16 |
| 2013/0326789 | A1* | 12/2013 | Lehrman | A41D 19/0034 2/160 |
| 2014/0289930 | A1* | 10/2014 | Moss | A63B 71/146 2/161.4 |
| 2014/0325739 | A1* | 11/2014 | Miller | A41D 19/0024 2/160 |

* cited by examiner

HAND COVERING APPARATUS

CROSS-REFERENCE TO RELATED APPLICATION

This application claims the benefit of priority of U.S. provisional application No. 62/126,765, filed Mar. 2, 2015, the entire disclosure of which is incorporated herein by reference.

INTRODUCTION

The present invention relates to a hand apparatus and, more particularly, to a glove or a mitten that is more conveniently securable on a user's hands. Gloves, or mittens, have many purposes. They can provide warmth by insulating heat. Additionally, they have functional uses such as providing grip. Gloves may also have an aesthetic purpose.

Typically, gloves may be pulled over the user's hand. They may be secured to the hand with an elastic hand that tightens around the wrist or with a hook and loop. Such gloves, however, may be inconvenient. They may be especially difficult for children, the elderly, the arthritic, or the physically disabled. Gloves that can easily accommodate a variety of different users' hands are preferable.

Broadly, an embodiment of the present invention provides a glove that encloses a user's hand inside the glove in a manner that is different than the elastic band or hooks and loop closure. The glove may comprise securing members on the body portion of the glove to provide a large space to put the hand.

SUMMARY OF THE INVENTION

The present invention addresses the needs above as well as other needs by providing a hand covering apparatus with securing members that comprise the body portion of a glove or mitten. The hand apparatus may comprise a hand receiving portion, one or more finger portions, a thumb portion, and a body portion. The body portion may comprise a dorsal side, palm side, a first securing member, a second securing member, and a third securing member. The securing members may be connected to the body portion, the first securing member extending from the near side of the body portion, the second securing member extending from the far side of the body portion, and the third securing member disposed on the dorsa side of the body portion between the near side and the far side. Furthermore, the securing members may comprise one or more fasteners that allow the securing members to be removably attachable to the other securing members.

DETAILED DESCRIPTION OF THE DRAWINGS

Figure 1:
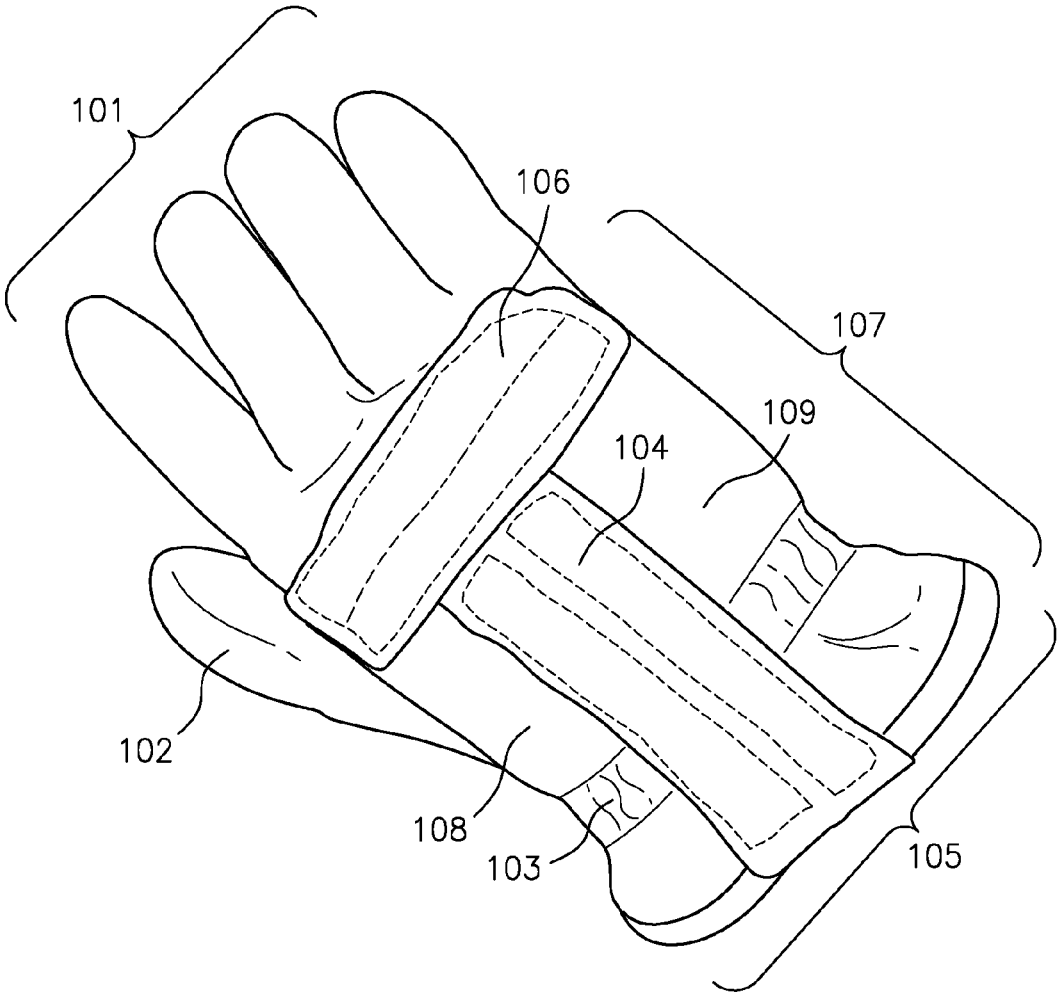
FIG. 1 is a dorsal side perspective view of an embodiment of a glove in the closed position.

The following description of the presently contemplated embodiments is not to be taken in a limiting sense, but is made merely for the purpose of describing the general principles of the invention. The scope of the invention should be determined with reference to the claims.

A hand covering apparatus, generally known as a glove or mitten but hereinafter referred to as a glove, may be used to cover a hand. The fingers may be placed into finger portions and the body of the hand may be placed into a body portion of the hand covering apparatus. With the hand inside the glove, three separate securing members connected on the dorsal or palm side of a body portion of the glove may be used to secure the hand. The securing members may include one or more fasteners. The glove is in the closed position when the fasteners on one set of securing members are attached to the fasteners on another set of securing members. A fastener may comprise one or more hooks and loops, magnets, zippers, clasps, or buttons.

As shown in FIGS. 1-5, the glove may comprise one or more finger portions 101, a thumb portion 102, and a body portion 107. The body portion may have a palm side 501, a dorsal side 104, a near side 402, a far side 403, and a hand receiving portion 105. The near side 402 may be disposed between the dorsal side and the palm side 501. The far side 403 may also be disposed between the dorsal side and the palm side 501, but opposite the near side 402. The glove may be made from cloth, leather, neoprene, lycra, rubber, or a combination thereof.

Furthermore, the glove may be of various sizes. In one embodiment, the glove may be made to fit tightly around the hand. In another embodiment, the glove may be significantly large enough to fit a hand that is in a cast.

In one embodiment, as shown in FIG. 1, a first securing member 108, a second securing member 109, and a third securing member 106 may comprise, and be connected to, the dorsal side of the body portion. The first securing member 108 is connected to the near side 402 of the body portion. The second securing member 109 is connected to the far side 403 of the body portion. The third securing member 106 is connected to the body portion 107 adjacent to the plurality of finger portions 101 and disposed perpendicular to the first securing member 108 and the second securing member 109. In another embodiment, the securing members may each be discrete, separate pieces, made of the same material or a different material, and detachable from the body portion of the glove.

In another embodiment, the securing members may comprise, and be connected to, the palm side 501 of the body portion. The hand may be placed into the glove with the hand's dorsal side first and the securing members may attach on the hand's palm side.

In another embodiment, the glove may comprise the first securing member 108 and the second securing member 109 without the third securing member 106. The first securing member 108 and the second securing member 109 may comprise the body portion and sufficiently cover the hand.

In yet another embodiment, the securing members may be made of elastic material. The first securing member 108 may not reach the second securing member 109 unless force is used to stretch the first securing member 108 toward the second securing member 109 (or vice versa).

The securing members (108, 109 and 106) may also be of various shapes and sizes. In one variation, the first securing member 108, the second securing member 109 and the third securing member 106 may be rectangular. In another variation, the securing members may be triangular. In yet another variation, the securing members may be semi-circular. And in yet another variation, the securing members may be a combination of various shapes and sizes.

The securing members may be of various lengths. In one embodiment, the first securing member 108 and the second securing member 109 may both extend one or more inches from the near side and the far side of the body portion, respectively, to attach to each other. In another embodiment, one of the securing members may not extend while the other securing member extends one or more inches to engage with the other mean securing member by means of the fasteners.

In one embodiment, the first securing member 108, the second securing member 109 and the third securing member 106 may attach in the closed position so as to fully conceal the dorsal side of the body portion of the user's hand. This may be preferable in situations where the glove is used for heat insulation. In another embodiment, the securing members may be sized so as to expose a portion of the dorsal side of the body portion of the user's hand. This may be preferable, for example, in athletic gloves where the user may want a breathable glove that permits adequate airflow.

FIG. 1 shows the glove in a closed position. In the closed position, the second fastener 302 (not shown) may attach to the fourth fastener 204 (not shown) and the third fastener 203 (not shown) may attach to the first fastener 301 (not shown) and the third fastener 401 (not shown). In another embodiment, only the second fastener 302 may attach to the fourth fastener 204.

Figure 2:
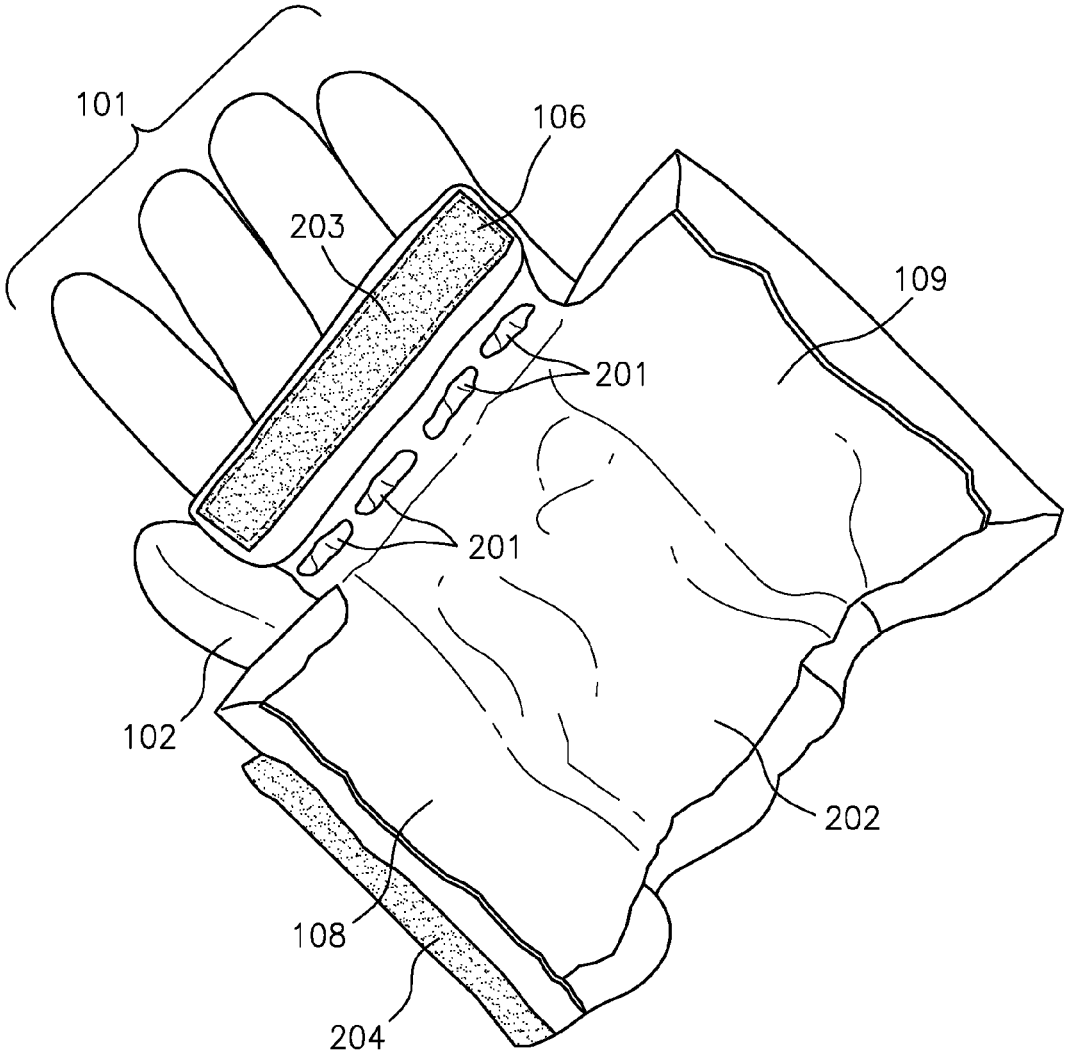
FIG. 2 is a dorsal side perspective view of an embodiment of a glove in the open position.

FIG. 2 is a dorsal side perspective view of an embodiment of the glove in the open position. As shown in FIG. 2, the glove may comprise an interior portion 202. The interior portion 202 may be made of cloth, leather, neoprene, lycra, rubber, fur, or a combination thereof. When the glove is in an open position, the first securing member 108, the second securing member 109, and the third securing member 106 are folded away from the body portion.

In one embodiment, the fasteners on the securing members may be visible when the glove is in the open position and not visible when the glove is in the closed position. In another embodiment, the fasteners may be embedded in the securing members and not visible on the outside. For example, when the glove uses magnetic fasteners, the fasteners may be embedded in between the exterior material and the interior material 202.

When the glove is in the open position, the finger inlets 201 for the plurality of finger portions 101 and the thumb inlet (not shown), adjacent to finger inlets 201, for the thumb portion 102 may be visible. This is advantageous and convenient for the user who may locate the inlet 201 for a particular finger portion from the glove's interior and glide the user's finger for insertion into the correct finger portion. In addition, this is helpful for a caretaker who may assist the user to more easily fit the user's fingers into the plurality of finger portions 101.

Figure 3:
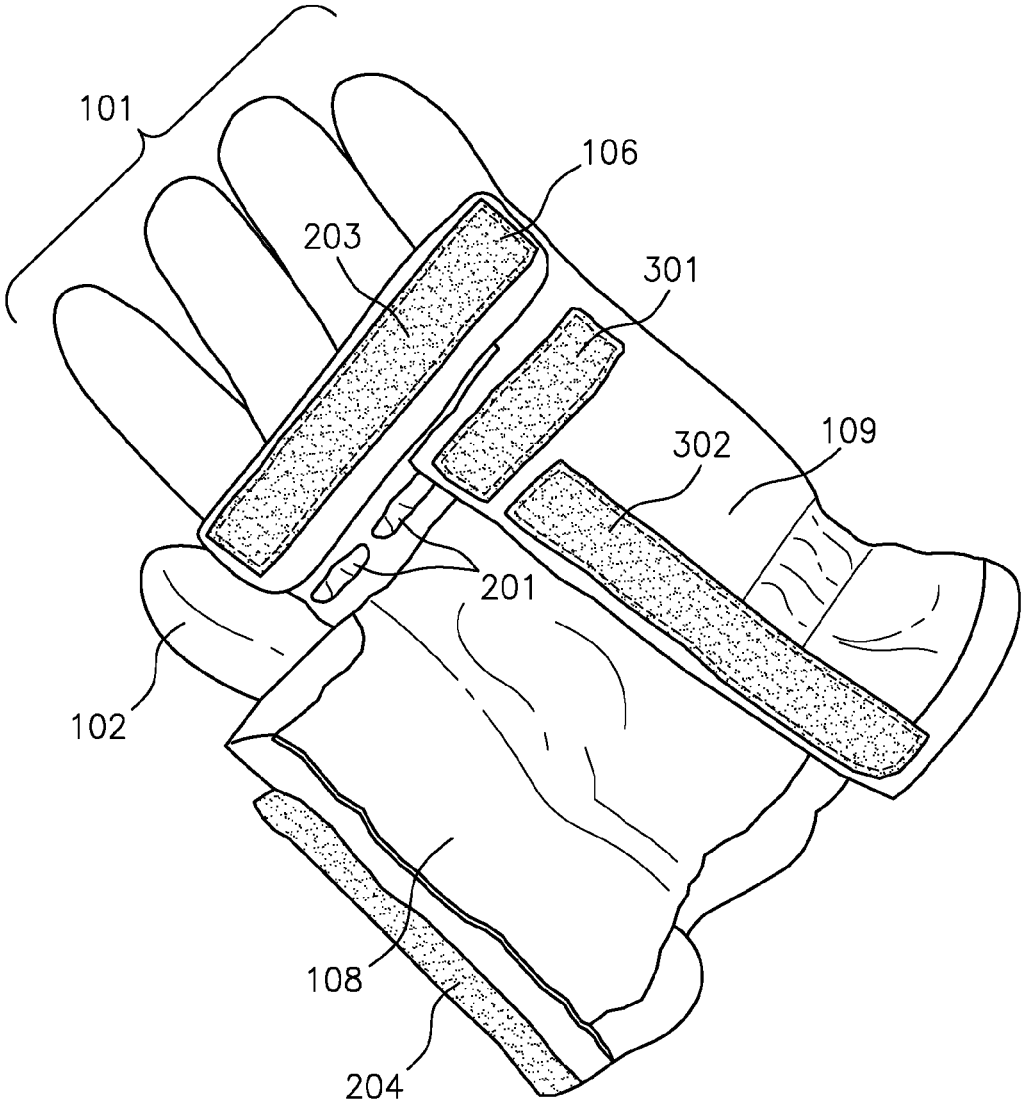
FIG. 3 is a dorsal side perspective view of an embodiment of a glove in the open position with the second securing member in the closed position.

FIG. 3 is a dorsal side perspective view of an embodiment of a glove in the open position with the second securing member in the closed position. Referring to FIG. 3, the user may fold the second securing member 109 over the user's hand. This may reveal the first fastener 301 and second fastener 302 of the second securing member 109. The first fastener 301 may be attached on the edge of the second securing member 109 closest to the third securing member 106 while the second fastener 302 may be attached on the edge of the second securing member 109 closest to the first securing member 108. The first fastener 301 and the second fastener 302 may be disposed orthogonally to one another. The first fastener 301 and the second fastener 302 of the second securing member may be the same continuous material, may be separate pieces of the same material, or may be two different materials.

Figure 4:
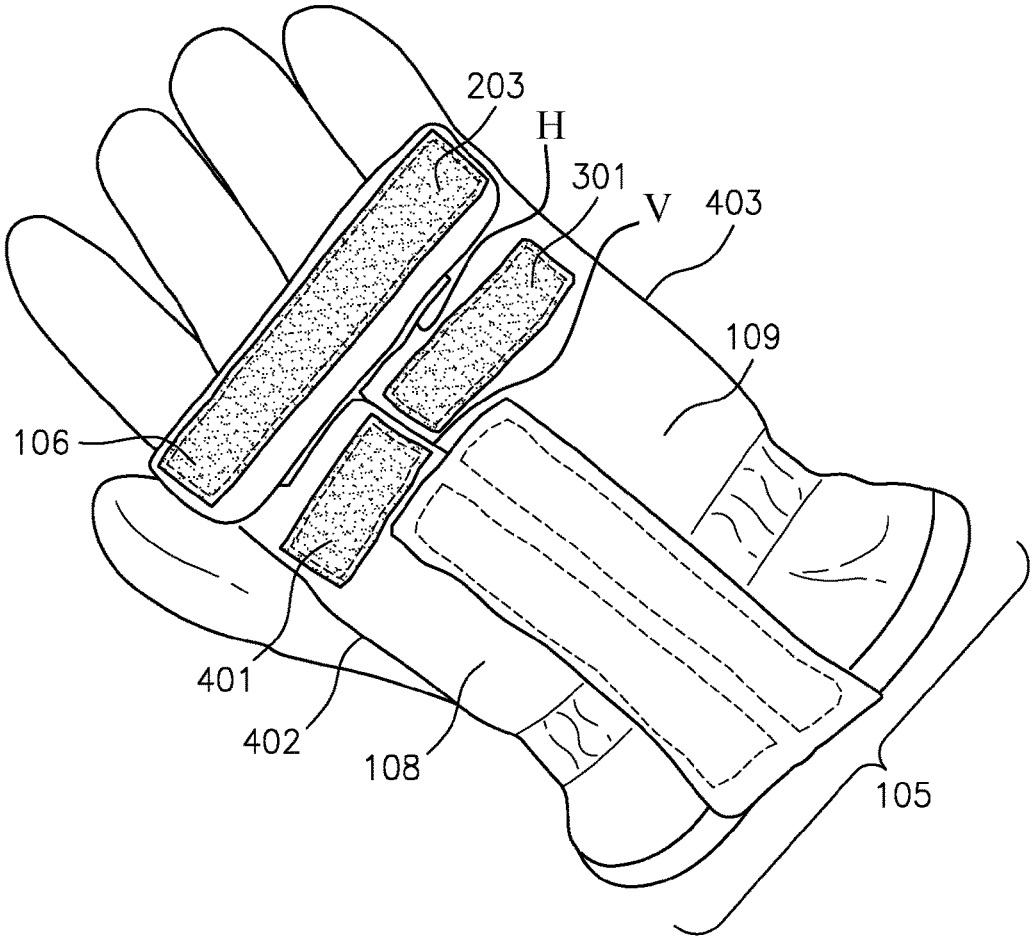
FIG. 4 is a dorsal side perspective view of an embodiment of a glove in the open position with the second securing member attached to the first securing member in the closed position.

As shown in FIGS. 3-4, after the second securing member is in the closed position, the first securing member 108 may be folded in the closed position. The first securing member 108 may comprise a third fastener 401 and a fourth fastener 204. In the open position, the third fastener 401 may not be visible but the fourth fastener 204 may be visible.

FIG. 4 is a dorsal side perspective view of an embodiment of a glove in the open position with the second securing member attached to the first securing member in the closed position. Referring to FIG. 4, as the user folds the first securing member over the dorsal side of the body portion of the user's hand, the fourth fastener 204 may attach to the second fastener 302 of the second securing member to close a vertical slit V. The second and fourth fasteners may not be visible once in the closed position. Furthermore, once the first securing member 108 is in the closed position, the third fastener 401 may be visible. The third fastener 401 and the fourth fastener 204 may be the same continuous material, may be separate pieces of the same material, or may be two different materials.

In another embodiment, the first securing member 108 may fold in the closed position first. Afterwards, the second securing member 109 may fold in the closed position. The fasteners would be arranged so that the first securing member attaches to the second securing member.

Referring to FIG. 4, the third securing member may comprise a fifth fastener 203. The third securing member 106 folds onto the first securing member 108 and the second securing member 109 and completes the closed position. When the fifth fastener 203 folds over the first securing member and the second securing member, the fifth fastener 203 may attach to the third fastener 401 and the first fastener 301. This closes a horizontal slit H and fully encloses the user's hand inside the glove and affixes the body portion 107 by reinforcing the coherence of the first securing member with the second securing member. The fifth fastener 203 may be one continuous material, may be multiple pieces of the same material, or may be multiple pieces of different materials.

When the glove is in the closed position, the hand may be placed in the glove by opening the securing members to form the open position (see, e.g., FIG. 2). However, the hand may be placed in the glove in the traditional manner by putting the hand through the hand receiving portion of the glove. Moreover, the hand may be taken out of the glove by detaching the securing members and setting the glove in the open position. But the hand may be taken out of the glove by sliding the hand out of the receiving portion as well.

In certain embodiments of the present invention, a wrist-securing elastic band 103 may be on the body portion 107 and may encompass the user's wrist when the user wears the glove. The elastic band 103 may be embedded between the interior material and exterior material of the glove but may also be embedded exclusively in the exterior material and/or the interior material themselves. The wrist-securing elastic band 103 can be advantageous for keeping the glove secured on the user's hand.

In one embodiment, the wrist-securing elastic band 103 may be embedded in the body portion but not in the portions thereof that extend into the first securing member 108 and/or the second securing member 109. In another embodiment, the wrist-securing elastic band may be embedded in the body portion, the first securing member 108 and the second securing member 109, and connected to the hook and loop fasteners in the first securing member 108 and the second securing members 109.

Figure 5:
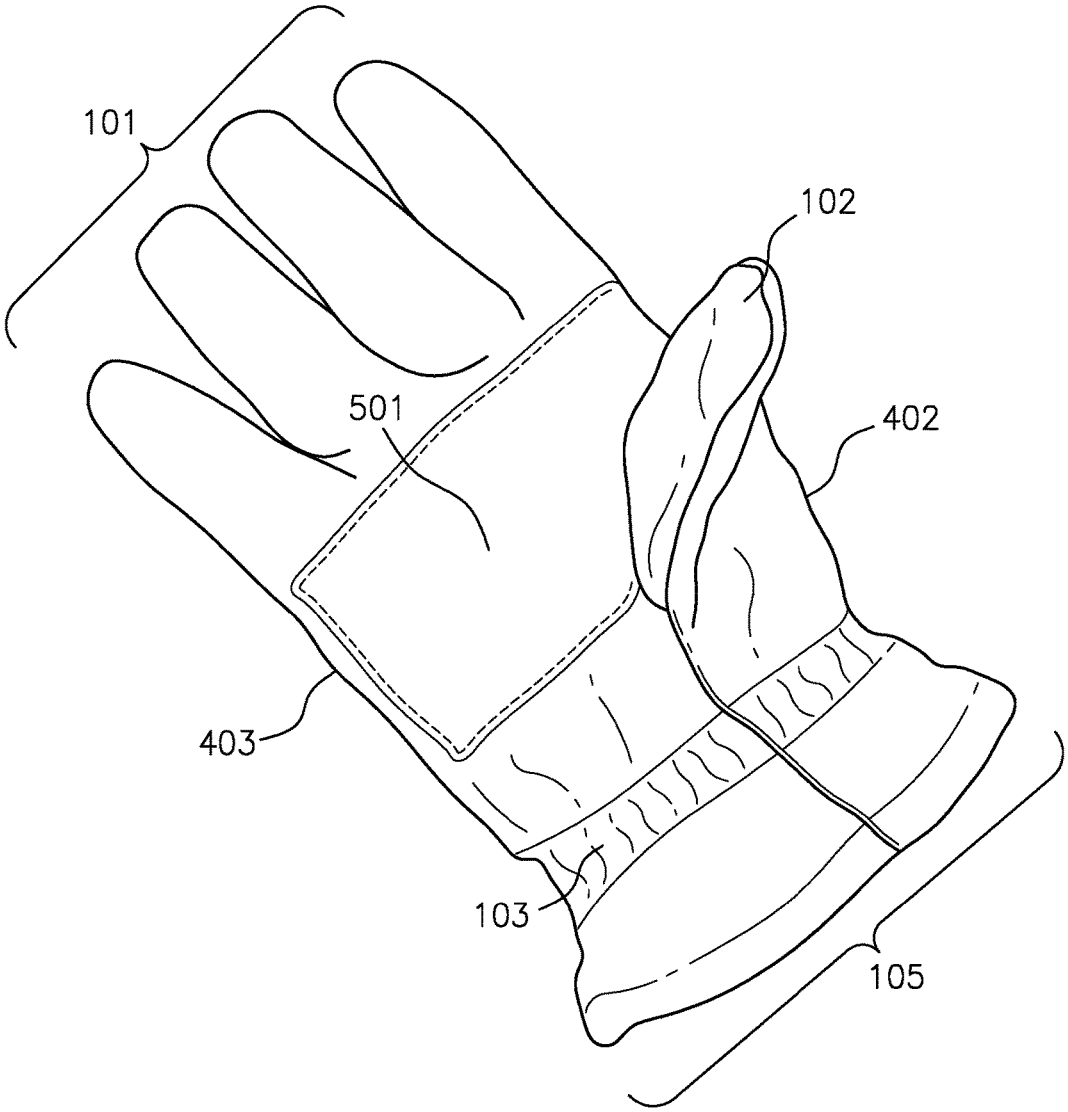
FIG. 5 is a palm side perspective view of a glove.

FIG. 5 is a palm side perspective view of a glove. In one embodiment, the securing members may be connected on the dorsal side 104 of the glove and the securing members may not be visible from the palm side 501 when the securing members are in the closed position. In another embodiment, the securing members may be connected on the palm side 501 of the glove, making the securing members visible from the palm side.

While the invention herein disclosed has been described by means of specific embodiments and applications thereof, numerous modifications and variations could be made thereto by those skilled in the art without departing from the scope of the invention set forth in the claims.

What is claimed is:

1. A hand apparatus, comprising:

a hand receiving portion comprising a wrist opening;

one or more finger portions;

a thumb portion; and a body portion;

the body portion comprising a dorsal side, a palm side, a first securing member, a second securing member, and a third securing member;

the dorsal side comprising a vertical slit and a horizontal slit;

the vertical slit extending from the wrist opening toward the one or more finger portions, the vertical slit extending substantially perpendicular to the wrist opening, the vertical slit dividing the dorsal side into a near side and a far side, the horizontal slit extending between the near side and the far side, the horizontal slit extending substantially perpendicular to the vertical slit and substantially parallel to the wrist opening;

the vertical slit extending between and terminating at the wrist opening and the horizontal slit:

the first securing member extending from the near side, the second securing member extending from the far side, the first securing member comprising the near side, the second securing member comprising the far side, and the third securing member being disposed on the dorsal side of the body portion between the near side and the far side and between the one or more finger portions and the horizontal slit;

each securing member comprises one or more fasteners:

the first securing member being removably attachable to the second securing member and the third securing member being removably attachable to the first securing member and the second securing member;

the hand apparatus comprising a closed configuration and an open configuration;

the closed configuration of the hand apparatus comprising:

the first securing member being external to the second securing member and the first securing member being attached to the second securing member; wherein attaching the first securing member to the second securing member substantially closes the vertical slit:

the third securing member being attached to a portion of the first securing member and a portion of the second securing member, and attaching the third securing member to the portions of the first and second securing members substantially closes the horizontal slit;

the open configuration of the hand apparatus comprising:

the first securing member detached from the second securing member and laterally unfolded at the near side of the body portion, wherein a fold line of the first securing member is disposed at the near side of the body portion, the second securing member detached from the first securing member and laterally unfolded at the far side of the body portion, wherein a fold line of the second securing member is disposed at the far side of the body portion, wherein the open configuration exposes an interior of the dorsal side of the body portion and an interior of the palm side of the body portion, wherein the open configuration exposes one or more inlets to the one or more finger portions.

2. The hand apparatus of claim 1, wherein the one or more fasteners are hook and loop fasteners.

3. The hand apparatus of claim 1, the one or more fasteners comprising magnets embedded in the first securing member, the second securing member, or the third securing member.

4. The hand apparatus of claim 1, wherein the first securing member and the second securing member are made at least partially of elastic material.

5. The hand apparatus of claim 1, wherein the second securing member extends one or more inches to attach to the first securing member.

6. The hand apparatus of claim 1, the first securing member extends one or more inches to attach to the second securing member.

7. The hand apparatus of claim 1, wherein the first securing member, second securing member, and third securing member are removably attachable on the dorsal side of the body portion.

8. The hand apparatus of claim 1, wherein the first securing member, the second securing member, and the third securing member are of rectangular shape.

9. The hand apparatus of claim 1, wherein the body portion comprises a wrist-securing elastic band that extends into the first securing member and the second securing member.

10. The hand apparatus of claim 1, wherein the body portion comprises a wrist-securing elastic band that does not extend into the first securing member or the second securing member.

* * * * *